US005769960A

United States Patent [19]

Nirmel

[11] Patent Number: 5,769,960

[45] Date of Patent: Jun. 23, 1998

[54] DEVICE AND METHOD FOR MANUALLY REMOVING A CLOG CONTAINING FIBROUS MATTER

[76] Inventor: Chittaranjan N. Nirmel, 1108 Portner Rd., Alexandria, Va. 22314

[21] Appl. No.: 498,469

[22] Filed: Jul. 5, 1995

[51] Int. Cl.[6] ..... B08B 9/02

[52] U.S. Cl. ..... 134/22.11; 15/104.31; 15/104.33

[58] Field of Search ..... 15/104.31, 104.32, 15/104.33, 104.05; 254/134.3 FT; 428/364, 367, 370; 140/59, 60, 61–55; 131/245; 134/8, 6, 22.11, 22.1

[56] References Cited

U.S. PATENT DOCUMENTS

| | | | |
|---|---|---|---|
| 556,110 | 8/1896 | Wrigley | 15/104.33 |
| 566,570 | 8/1896 | Frick | 15/209.1 |
| 750,357 | 1/1904 | Gibbons | 15/104.31 |
| 834,135 | 10/1906 | Hymes | 15/104.33 |
| 1,051,992 | 2/1913 | Fisher | 15/104.32 |
| 1,261,444 | 4/1918 | Scheid | 15/104.33 |
| 1,780,436 | 11/1930 | Miller | 15/104.33 |
| 1,845,442 | 2/1932 | Robinson | 15/104.33 |
| 1,851,766 | 3/1932 | Hotchkiss, Jr. | 15/104.33 |
| 2,066,598 | 1/1937 | Weissner | 15/104.33 |
| 3,950,934 | 4/1976 | Irwin | 15/104.33 |
| 4,253,211 | 3/1981 | Mockel | 15/104.32 |
| 4,644,603 | 2/1987 | Meyer | 15/104.33 |
| 4,666,530 | 5/1987 | Houser | 15/104.33 |
| 4,774,739 | 10/1988 | Sherman, Jr. | 254/134.3 FT |
| 4,926,518 | 5/1990 | Mikol | 15/104.33 |
| 5,230,116 | 7/1993 | Rodriguez | 15/104.33 |
| 5,251,339 | 10/1993 | Piskula | 15/104.32 |

FOREIGN PATENT DOCUMENTS

| | | | |
|---|---|---|---|
| 521188 | 8/1995 | Belgium | 14/104.33 |
| 22780 | of 1905 | United Kingdom | 131/245 |

*Primary Examiner*—Tony G. Soohoo
*Attorney, Agent, or Firm*—Chittaranjan N. Nirmel

[57] ABSTRACT

A smooth-surfaced, firm, and flexibly bendable elongate element has a clog-snagging end portion which is provided at least one clog-snagging outwardly extended clog-snagging element. The clog-snagging portion is forcibly inserted through a drain hole into a water trap in which a fibrous clog has formed and is to be removed. A portion of the elongate element outside the water trap is flexibly shaped into a crank shape by the hands of the user, and is manually rotated to cause engagement between the clog-snagging element and twisting thereon of fibrous material contained in the clog. Upon such engagement, the elongate element is forcibly withdrawn from the drain hole with a portion of the clog detached from the water trap and engaged thereto.

10 Claims, 2 Drawing Sheets

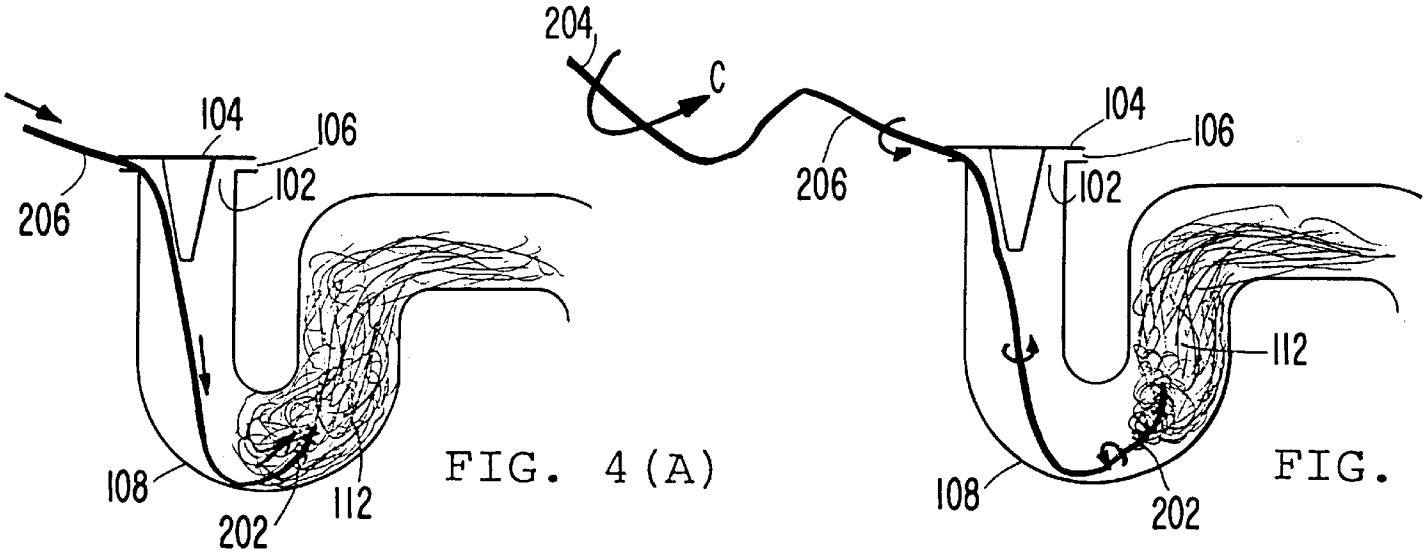
FIG. 4(A)
FIG. 4(B)
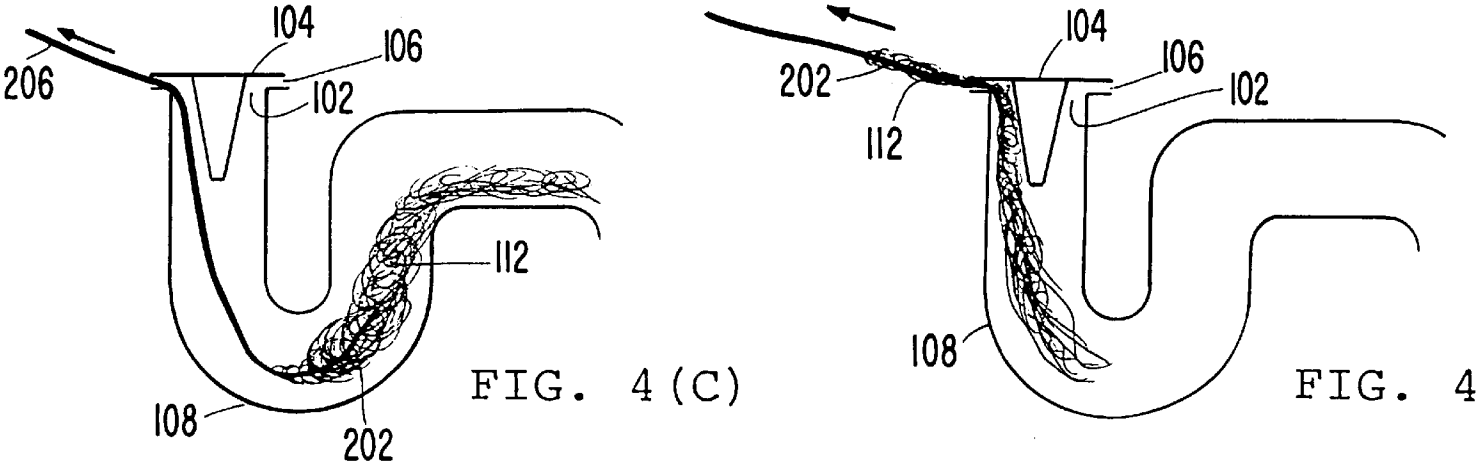
FIG. 4(C)
FIG. 4(D)

DEVICE AND METHOD FOR MANUALLY REMOVING A CLOG CONTAINING FIBROUS MATTER

FIELD OF THE INVENTION

This invention relates to a device for removing clogs containing fibrous matter, such as hair-clogs which commonly develop in the U-shaped water traps provided at the drains from baths, sinks and showers; and more particularly to an inexpensive, easy-to-use, and highly effective manually-operable device for quickly removing clogs containing fibrous matter, e.g., human or animal hair, in an environment-friendly manner without the use of caustic chemicals, enzymes, or the like.

BACKGROUND OF THE RELATED ART

We all know that sooner or later hair which we shed from our heads while taking showers or shampooing will eventually form a clog in the typical U-shaped water trap commonly provided under the drain hole of the bathtub, shower or sink. People often shampoo their pets in their bathtubs, and for certain species of pets, e.g., long-haired dogs, the consequence is the rapid formation of a hair-clog. Until the clog is removed, drainage of dirty water is slowed down or stopped, creating an annoying problem.

One solution to this problem, which works if the clog has not had time to develop into a substantial obstruction in the drain passage, is to use a plunger having a flexible rubber bell-shaped end. Such a device acts by alternately causing high pressure (when forcibly pressed downward) and suction (when forcibly pulled upward). When such a maneuver is performed with water standing over the drain, it is sometimes possible to forcibly dislodge the clog and cause hydrostatic pressure of the standing water to wash it away.

Another solution is to pour in a solution of a caustic material which has the ability to chemically react with both the greasy material and the hair to dissolve the clog. One commercially available substance of this kind is sold under the name "LIQUID PLUMBER". Another chemical remedy requires a user to pour into the clogged drain crystalline caustic soda, i.e., sodium hydroxide, which is a powerful caustic chemical which also chemically reacts with grease in the clog and on the hair itself.

The problem with both the liquid and crystalline caustic chemicals is that the user must be extremely careful in using them as such materials can hurt skin and may cause blindness if splashed into the eye. Yet another danger is that young children may access such dangerous chemicals. Also, disposal of the containers of the chemicals, with caustic residues still contained therein, requires particular care.

Most people may not be very concerned about occasionally pouring in liquid or crystalline caustic chemicals to remove hair-containing clogs. The solution is not long-lasting, however, and such remedies have to be practiced frequently. The consequence for society is that large quantities of caustic chemicals are thus poured into the water which enters the sewer system and, eventually, the ground water. When millions of people every few months dump in a few ounces of highly caustic material in this manner, the consequence over time is definitely unfriendly to the environment. As people become more conscious of this, other remedies become more desirable, and the present invention is intended to address this particular need.

SUMMARY OF THE INVENTION

Accordingly, a principal object of this invention is to provide a simple, inexpensive, manually-operated device for quickly removing from U-shaped water traps clogs containing fibrous material.

A related object according to another aspect of this invention is to provide a method by which almost anybody can inexpensively, simply, safely, and in an environmentally-friendly manner very quickly remove hair-containing clogs from the typical U-shaped water trap found at the drains of bathtubs, showers and sinks.

These and other related objects are realized by providing a device for manually removing a clog containing tangled fibrous matter from a U-shaped water trap. The device according to a preferred embodiment comprises a smooth-surfaced, firm, and flexibly bendable elongate element which has a clog-snagging end portion and a manually graspable end portion. At least one clog-snagging element having an outwardly extending distal end is provided at the clog-contacting end portion. The elongate element has a firmness and a cross-section small enough to allow flexible insertion of the clog-snagging end portion into the U-shaped trap and into the clog contained therein. The elongate element is made of a length and flexibility sufficient to allow a user to loosely grasp a portion thereof intermediate the clog-snagging and the manually-graspable ends with a first hand, while loosely grasping the graspable end portion with another hand and cranking the elongate element. This causes rotation of the clog-snagging element provided at the clog-contacting end portion inserted into the clog, and the result is that the fibrous matter, e.g., hair in the clog, is snagged and wound onto the clog-snagging end portion of the element. All that the user has to do then is to forcibly pull the inserted portion of the elongate element out of the U-shaped water trap to thereby remove the engaged portion of the clog and the fibrous material contained therein. A user may find it advisable to remove the clog a small portion at a time, but the entire operation should require no more than a minute or two and should result in virtually total removal of the hair-containing clog and restoration of effective draining through the U-shaped water trap.

In a related aspect of the invention, there is provided a method for removing a clog containing fibrous matter from U-shaped water trap of the type typically found at the drains of bathtubs, showers and sinks. The method includes the steps of inserting into the U-shaped water trap and then into the clog a clog-snagging element extending outwardly of a clog-snagging end portion of a flexible, bendable, smooth-surfaced elongate element; and then loosely grasping with one hand a portion of the elongate element at a manually graspable end portion thereof, loosely grasping the elongate element with another hand at a portion intermediate the clog-snagging and the manually graspable end portions, and cranking the elongate element rotationally. The result is that the clog-snagging element at the clog-snagging end portion inserted into the clog engages a portion of the fibrous matter of the clog, and the rotation winds the fibrous matter onto the clog-snagging end of the element while pulling it away from the inside surface of the U-shaped water trap. The final step is for the user to forcibly pull the engaged portion of the clog out of the water trap, to pull it off the elongate element and discard the clog.

These and other related aspects of the invention will be better understood with reference to the drawing figures and the detailed description provided below. It is expected that obvious variations of both the device and the method disclosed herein will become apparent to persons of ordinary skill in the art upon developing an understanding of the invention as disclosed herein.

BRIEF DESCRIPTION OF THE DRAWING

FIGS. 4(A)–4(D) show stages in the method of using the device in its preferred embodiments. FIG. 4(A) is an enlarged vertical cross-sectional view of a U-shaped water trap containing a clog including fibrous matter, with the clog-snagging end portion according to the first preferred embodiment of this invention forced into the clog; FIG. 4(B) shows the consequence of cranking the element rotationally, as generally indicated in FIG. 1, which results in engagement of the fibrous matter of the clog by the clog-snagging elements; FIG. 4(C) shows how the rotational engagement per FIG. 4(B) causes the clog to become detached from the inside surface of the U-shaped water trap; and FIG. 4(D) shows how the engaged portion of the detached clog may be pulled out of the U-shaped water trap past a conventional drain-stopper which is disposable to leave a small gap for normal draining of water via the water trap.

DETAILED DESCRIPTION OF THE PREFERRED EMBODIMENTS

Figure 1:
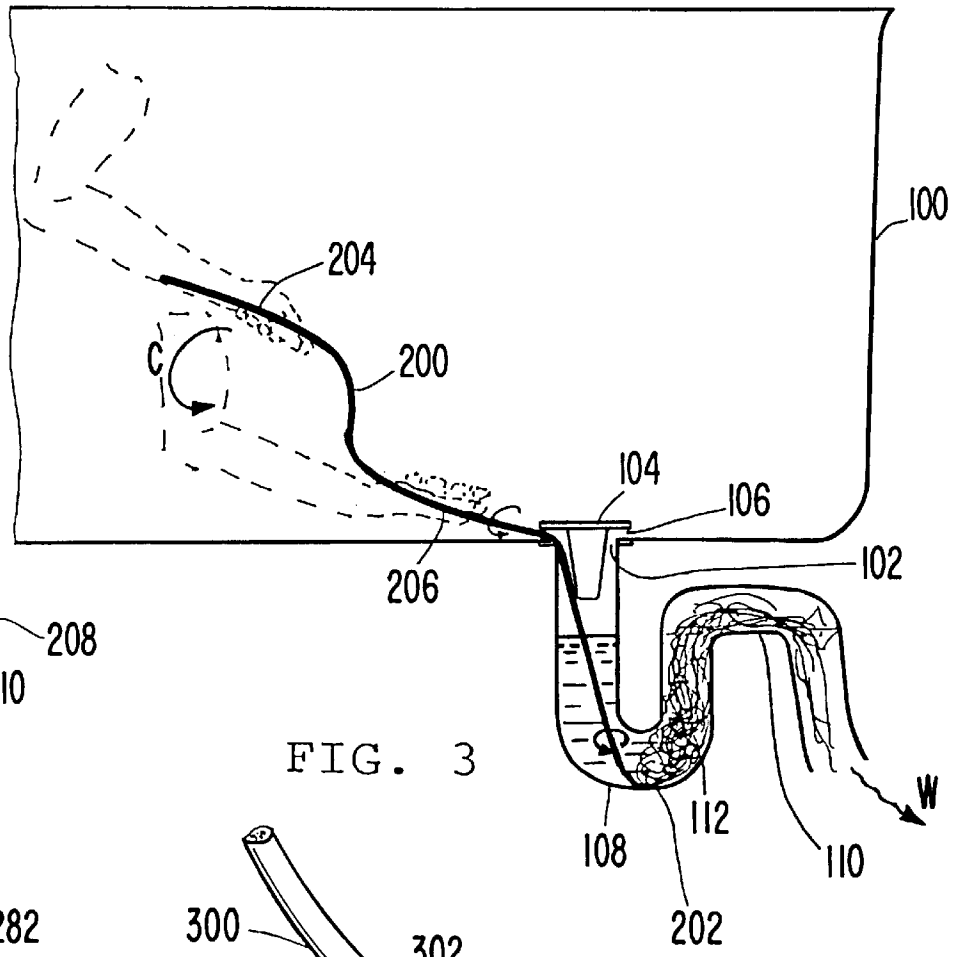
FIG. 1 is a vertical cross-sectional view through an exemplary water container with a drain hole at which is provided a typical U-shaped water trap in which a clog containing fibrous matter is formed, to illustrate the manner in which the preferred embodiment of the invention is to be used.

As best understood with reference to FIG. 1, the typical water-container 100, such as a conventional bathtub, the bottom of a stand-up shower, or a sink, has a drain hole 102. At least in many bathtubs of current design, there is also provided a drain-stopper 104 which is disposable in a raised position (as shown) so as to leave an annular peripheral drainage gap 106, typically approximately ¼ to ½" in height all around the drain hole 102. The stopper is also disposable lower in a position such as to close this drainage gap 106, and there may be a lever-operable mechanism (not shown) for moving the stopper 104 between its open and closed positions. A compressible annular gasket (not shown) may be provided between drain-stopper 104 and drain hole 102. Immediately beneath drain hole 102 there is typically provided a U-shaped water trap 108 to which is connected a drainage pipe 110 through which water is normally expected to flow, as generally indicated by the wiggly arrow W.

The consequence of providing such an arrangement is that there is always a quantity of water filling the U-shaped water trap 108. This prevents transit of odorous gases from the sewer into the bathtub through the drain, and may also prevent ingress of insects from the drains and sewers and up through the drain hole 102.

Over a period of time, as persons and/or animals are washed and inevitably shed hair of varying lengths, one or more of the hairs being sufficiently long, sticky, or otherwise slow-moving in the water flow, will tend to attach itself to the inside surface of the U-shaped water trap 108. This probably begins to happen at the downstream upper end of U-shaped water trap 108. Eventually, other hairs get entangled with the first one and they start matting and collecting skin cells, body grime, soap scum, and other detritus contained in the water draining out of the water container 100. After a while, this results in the formation of the slowing-expanding clog 112 containing fibrous material, as best seen in FIGS. 1 and 4(A).

As shown in FIG. 1, the device according to the first preferred embodiment of this invention is an elongate element 200 which is firm but flexibly bendable and is provided over most of its length with a smooth outer surface. A preferred length of elongate element 200 for use in homes, hotels, and the like is between 15 in. and 20 in. A suitable outside diameter for the elongate party of device 200 is in the range ⅛ in. to ¼ in. The device has a clog-snagging end portion 202, a hand-graspable end portion 204, and a central or intermediate portion 206 therebetween.

In the first preferred embodiment, the body of device 200 is formed of a monofilament of a suitable plastics material very strong monofilament fishing line for sports fishing, to catch large, powerful and heavy fish such as sharks, is typically made of nylon to a diameter of about 3/16 in. and is considered highly suitable for forming the device. It is readily available commercially and can be cut in suitable lengths by any conventional shearing or cutting tool, either manually or by any conventional power-drive.

Figure 2A:
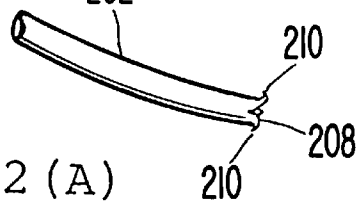
FIGS. 2(A)–2(D) are side elevation views of the clog-snagging end portion of the device according to variations of a first preferred embodiment.

As best understood with reference to FIG. 2(A), the clog-snagging end portion 202 of this first preferred embodiment has a distal end 208, which may be provided cuts, or distressed and deformed, so as to have outwardly extending end elements 210 integrally formed therein to hook and snag fibrous material when inserted into clog 112.

Figure 2B:
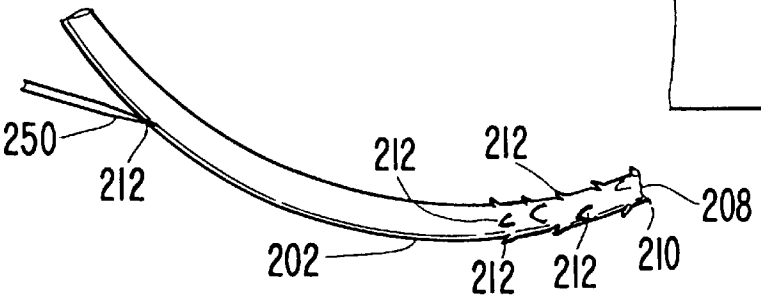
Figure 2D:
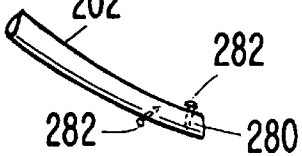

While these end elements 210 may suffice, a more assured engagement is obtained by lancing out of the smooth outer surface of the clog-snagging end portion 202 side elements such as 212, as best seen in FIG. 2(B). Some of these are shown in profile, and it will be appreciated by persons of ordinary skill in the art that they may be formed simply by a sharp cutting edge 250 having a generally wedge shape. The application of such a wedge-shaped cutting edge 250 is shown, purely for illustrative purposes, at the left-hand side of FIG. 2(B). A preferred angle of attack of such a sharp edge relative to the immediately adjacent smooth surface of the elongate body 200 is in the range 20° and 75°. The depth of such a lancing cut is preferably within the range 5% to 20% of the transverse dimension, e.g., the diameter of a cylindrical elongate element 200. The resulting clog-snagging side elements will be integral with the parent material of elongate element 200. Fibrous material of the clog will tend to get caught within the cuts made to form the side elements 212.

As will be appreciated, a curved sharp edge may be used instead of a straight wedge-shaped edge 250 to obtain the lanced-out clog-snagging side elements 212.

Persons of ordinary skill in the art may be expected to consider such variations. The cross-section of the body of elongate element before making of the cuts does not have to be circular, but may have other shapes that can facilitate formation of the integral, cut-in-place, clog-snagging side elements 212.

Figure 2C:
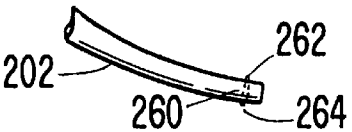

In another variation, as best seen in FIGS. 2(C), a short length of metal wire 260 is forcibly pushed through the clog-snagging portion 202 traversely of a longitudinal direction thereof, in such a manner that small exposed end portions 262, 264 of the wire 260 stick outwardly of the otherwise smooth surface of the elongate element 200. These outwardly extending and portions of metal wire 260 constitute the clog-snagging elements in this embodiment. Once they are forcibly pushed into a clog containing fibrous material, and rotated by cranking of the elongate element 200 as described with reference to FIG. 1, individual fibers will snag onto exposed end portions 262, 264 and will entangle other fibers and thus the clog 112 itself. Exposed ends 262, 264 of the wire 260 may preferably extend to lengths in the range 1/32–1/16 in., and wire 260 preferably has a diameter in the range 1/50–1/30 in.

In yet another variation, best seen in FIG. 2 (D), one or more small nails 280, each having a small head 282, may be driven into the clog-snagging portion 202 so as to leave a short length and a head to serve as the outwardly extending clog-snagging element. The presence of head 282 should help retain twisted-on fibrous material to the distal end of clog-snagging portion 202 and facilitate pulling out of the clog as best understood with reference to FIGS. 4(A)–4(D) (described more fully hereinbelow).

The nails 280 may have diameters comparable to the wire 260 and may preferably extend outwardly to a comparable extent.

Other variations, e.g., punching-out or molding-on outwardly extending clog-snagging elements will no doubt be viable alternatives and are considered to be comprehended with the scope of this invention.

Figure 3:
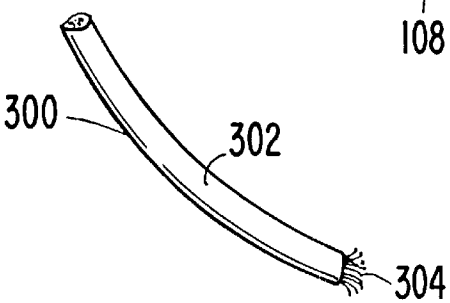
FIG. 3 is a side elevation view of a clog-snagging end portion of the device according to another preferred embodiment of this invention.

As best understood with reference to FIG. 3, in another preferred embodiment of this invention, the body of elongate element 200, instead of comprising only a plastic, may conveniently be a multi-strand metal wire sheathed in a smooth, tough, plastics material. The clog-snagging end portion 300 of such an element is formed with the plastic sheathing 302 stripped off over a short length at the extreme distal end, so that corresponding short lengths of the individual wires 304 are exposed. In this embodiment, by any convenient means, e.g., by distressing the ends of the exposed wires, at least a few of the wires are bent outward at their very distal ends, as shown in FIG. 3. These outwardly bent portions of the wires 304 will then serve as the clog-snagging elements provided at the clog-snagging end portion 300 to hook and engage fibrous material in clog 112.

In all of the described embodiments, i.e., per FIGS. 2(A)–2(D) and 3, the smooth, tough, plastic material of either the body of the element or the sheath, as the case may be, ensures that forcible insertion of the clog-snagging end portion 202 or 300 through the bent passage between stopper 104 and drain hole 102 through gap 106 can be readily accomplished. This insertion is obtained by grasping the body of elongate element 200 and simply pushing the clog-snagging end portion 202 or 300 into the water trap 108 via gap 106. The clog-snagging end portion 202 will be guided by the lower inside curved surface of U-shape of water trap 108 and will move upward into the clog 112, as best seen in FIG. 4(A). The user may feel this as an increased resistance, but even if no substantial increased resistance is felt, the user should be able to estimate that about 6 to 10 in. of the elongate element 200 have thus been inserted.

The user should then grasp the intermediate portion 206 loosely in the fist of one hand, and the graspable end portion 204 loosely in the fist of the other hand. By disposing the hands side-by-side and pushing the graspable end portion 204 in the direction of the drain hole, the crank-shape shown in FIG. 1 is readily formed. The user should then continue to loosely hold the elongate element 200 in both hands and, using the crank shape, crank the elongate element 200 as generally indicated by the curved arrow C.

The user may be surprised to find that such a cranking motion results in rotation of the entire element 200 about its longitudinal direction regardless of all the curves formed therein. In other words, the user does not have to grasp the relatively small diameter element with so much force as to be able to turn it by grasping it irrotatably in his or her hands. The crank-shape and loose grasping of the element, as described above, makes the rotating of element 200 an extremely easy matter and. is one of the principal inherent advantages of the invention as described.

The rotation of elongate element 200 and its clog-snagging end portion 204 will cause rotation of the clog-snagging elements, i.e., 210, 212, 262, 282 or 304, and resultant entangling engagement of these snagging elements with the fibrous material of clog 112. As will be readily appreciated, this will result in twisting of the fibrous material, e.g., human hair, and will progressively tighten the clog inwardly and tend to pull it away from the inside surface of the U-shaped water trap 108. See FIG. 4(B). In other words, the clog will be tightened in upon itself, pulled away from the wall to which it had previously adhered, and become firmly entangled with the clog-snagging elements of element 200. See FIG. 4(C). If the clog is substantially large, i.e., is has effectively stopped all drainage through drain hole 102, the user may prefer to thus engage only portions of the clog and, thereafter, to stop the rotation and simply pull the element out of the gap 106 with the tangled material dragged thereby out of the U-shaped water trap 108. See FIG. 4(D). The process can be repeated if necessary as best determined by seeing how fast water drains out via gap 106, and repeating until it does so swiftly. Each repetition should take no more than a few seconds. Thus, in a matter of one or two minutes even a major clog can be totally removed and discarded.

Persons of ordinary skill in the mechanical arts will appreciate that by proper sizing of the above-discussed dimensions of key portions of the device it can be made suitable for use in virtually any kind of drain. If the drain stopper as shown in FIG. 1 is not permanently located in place, and even where a plurality of holes are provided to allow the water to drain into the water trap, the device should be operable with ease.

Since the materials of which the device is made, in all of the preferred embodiments, are all relatively inexpensive, the user may simply discard the device after removing the clog. Another device can be bought inexpensively for future use. On the other hand, if the user is a thrifty person, he or she may wish to carefully rinse off the device after use, preferably with household bleach or other disinfectant and should dry it before storage for future use.

Since this invention may require physical contact with the material of the clog, it is considered highly desirable that the user should wear plastic or latex gloves for good hygiene. This is particularly advisable under circumstances where it is not the user's own hair, or his or her family's hair, which is to be handled. Such situations may arise in, for example, beauty salons where shampooing of numerous customers is done every day and hair clogs may have to be removed and must involve the hair of any number of strangers. It could also arise in hotels, dormitories, and at campgrounds. Since the present invention totally eliminates the use of caustic chemicals which may damage the environment, this additional precaution while necessary will probably be considered a relatively small burden by those who respect the environment.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A device for manually removing a clog containing tangled fibrous matter from a water trap, comprising:

a firm and flexibly bendable elongate element having a smooth-surfaced body comprising a plastic material, the body having a clog-snagging end portion and a manually-graspable end portion; and at least one clog-snagging element having a distal end extending outwardly of the clog-snagging end portion, said elongate element having a cross-section selected to allow a user to insert the clog-snagging end portion into the water trap and into the clog, manually bend the elongate element to a crank shape, grasp the elongate element loosely in both hands, and manually crank the elongate element to thereby snag, twist and then forcibly draw at least a portion of the clog out of the water trap.

2. The device according to claim 1, wherein:

the body of the elongate element is a monofilament formed of the plastic material; and the at least one clog-snagging element is formed by locally lancing out the plastic material at the surface of the clog-snagging end portion.

3. The device according to claim 1, wherein:

the body of the elongate element is a monofilament formed of the plastic material; and the at least one clog-snagging element is formed by shaping the distal end of the clog-snagging end portion to extend parts thereof outwardly of the surface of the clog-snagging portion.

4. A device for manually removing a clog containing tangled fibrous matter from a water tray, comprising:

a firm and flexibly bendable elongate element having a smooth-surfaced body comprising a clog-snagging end portion and a manually-graspable end portion; and at least one clog-snagging element having a distal end extending outwardly of the clog-snagging end portion, said elongate element having a cross-section selected to allow a user to insert the clog-snagging end portion into the water trap and into the clog, manually bend the elongate element to a crank shape, grasp the elongate element loosely in both hands, and manually crank the elongate element to thereby snag, twist and then forcibly draw at least a portion of the clog out of the water trap, the at least one clog-snagging element comprises at least one length of wire disposed transversely of a longitudinal direction of the clog-snagging portion, the at least one length of wire having two end portions each exposed and extending outwardly of the clog-snagging portion.

5. The device according to claim 1, wherein:

the elongate element comprises at least one metal wire and a plastic sheath closely surrounding the same; and a distal end of the at least one wire is left unsheathed by removing the plastic sheath therefrom at the clog-snagging end portion and the unsheathed end is bent outwardly to provide the at least one clog-snagging element.

6. A device for manually removing a clog containing tangled fibrous matter from a water tray, comprising:

a firm and flexibly bendable elongate element having a smooth-surfaced body comprising a clog-snagging end portion and a manually-graspable end portion; and at least one clog-snagging element having a distal end extending outwardly of the clog-snagging end portion, said elongate element having a cross-section selected to allow a user to insert the clog-snagging end portion into the water trap and into the clog, manually bend the elongate element to a crank shape, grasp the elongate element loosely in both hands, and manually crank the elongate element to thereby snag, twist and then forcibly draw at least a portion of the clog out of the water trap, the clog-snagging element comprises at least one short nail provided transversely of a longitudinal direction of the clog-snagging portion, the nail having a head and at least a short portion adjacent said head extending outwardly of the clog-snagging portion to facilitate snagging of fibrous matter thereat.

7. An apparatus for removing a hair-containing clog from a water trap of any of a bath, a shower, and a sink, comprising:

a smooth-surfaced elongate monofilament of a stiff and flexible plastic material; and hair-snagging elements extending outwardly of the smooth surface at a clog-snagging end of the monofilament insertable into the water trap and the hair-containing clog, a length of the elongate monofilament extending outside of the water trap being flexibly bendable into a crank-shape for manual rotation thereof, to thereby engage the hair in the clog with the rotated hair-snagging elements inserted into the clog to facilitate engagement with and forcible pulling out of the hair-containing clog from the water trap.

8. An apparatus for removing a hair-containing clog from a water trap of any of a bath, a shower, and a sink, comprising:

a smooth-surfaced and flexibly bendable first length of plastic-sheathed multistrand wire having a clog-snagging end; and hair-snagging elements extending outwardly of the plastic sheath at the clog-snagging end to be insertable into the water trap and the hair-containing clog, wherein the hair-snagging elements comprise exposed bent distal portions of individual wires of the multistrand wire, and wherein a portion of the plastic-sheathed wire during use extends outside of the water trap to a second length sufficient to be bent into a crank-shape and grasped thereat by a user for manual rotation of the clog-snagging end, to thereby engage the hair in the clog with the rotated hair-snagging elements inserted into the clog to facilitate engagement with and forcible pulling out of at least a portion of the hair-containing clog from the water trap.

9. A method for manually removing a clog containing fibrous matter from a U-shaped water trap, comprising the steps of:

inserting into the U-shaped water trap, and into the clog, at least one clog-snagging element extending outwardly of a clog-snagging end portion of a flexibly bendable, smooth-surfaced elongate element;

loosely grasping with one hand a manually graspable end portion of the elongate element outside the water trap, loosely grasping the elongate element with another hand at a portion intermediate the clog-snagging and manually graspable end portions, and manually cranking the elongate element rotationally, whereby the at least one clog-snagging element at the clog-snagging end portion inserted into the clog engages with, twists, and detaches at least a portion of the fibrous matter of the clog away from an inside surface of the water trap; and forcibly pulling the elongate element and the detached portion of the clog out of the water trap.

10. A method of removing at least a portion of a clog containing fibrous matter, comprising the steps of:

forcibly inserting into the clog at least one clog-snagging element extending outwardly of a clog-snagging distal end portion of a flexibly bendable coil-free elongate element;

manually bending a proximate lengthwise portion into a crank shape and cranking the manually bent cranking portion of the elongate element to thereby rotate the clog-snagging element to snag some of the fibrous matter of the clog; and pulling the elongate element to remove at least a portion of the snagged matter from the clog with the clog-snagging element.

* * * * *